US007171719B1

(12) United States Patent
Harrelson

(10) Patent No.: US 7,171,719 B1
(45) Date of Patent: Feb. 6, 2007

(54) DISPOSAL APPARATUS

(76) Inventor: David Harrelson, 4806 Malibu Dr., Bloomfield Hills, MI (US) 48302

( * ) Notice: Subject to any disclaimer, the term of this patent is extended or adjusted under 35 U.S.C. 154(b) by 112 days.

(21) Appl. No.: 10/899,786

(22) Filed: Jul. 27, 2004

(51) Int. Cl.
*A47L 13/52* (2006.01)

(52) U.S. Cl. ..... 15/257.3; 15/257.1; 15/257.2; 15/257.9

(58) Field of Classification Search .... 15/257.1–257.3, 15/257.9; 141/391; 248/95, 99–101; 294/1.3
See application file for complete search history.

(56) References Cited

U.S. PATENT DOCUMENTS

| | | | | | |
|---|---|---|---|---|---|
| 2,528,332 | A | * | 10/1950 | Bergquist | 229/125.02 |
| 2,596,806 | A | * | 5/1952 | Borkoski | 55/367 |
| 3,245,605 | A | * | 4/1966 | Meyerhoefer | 55/381 |
| 4,796,938 | A | | 1/1989 | Knights | |
| 4,809,390 | A | | 3/1989 | Jackson et al. | |
| 4,977,638 | A | | 12/1990 | Best | |
| 5,107,666 | A | * | 4/1992 | Rahtican | 56/202 |
| 5,407,089 | A | | 4/1995 | Bird et al. | |
| 5,425,153 | A | | 6/1995 | Vosbikian | |
| 5,560,077 | A | | 10/1996 | Crotchett | |
| 5,785,369 | A | | 7/1998 | Ridley, Sr. et al. | |
| 5,799,360 | A | | 9/1998 | Vosbikian | |
| 5,852,843 | A | | 12/1998 | Vosbikian | |
| 5,878,461 | A | | 3/1999 | Killian | |
| 6,199,714 | B1 | | 3/2001 | Thompson | |
| 6,267,260 | B1 | | 7/2001 | Lyons | |
| 6,671,924 | B1 | | 1/2004 | Rood | |
| 6,698,058 | B2 | | 3/2004 | Cann | |
| 6,708,742 | B2 | * | 3/2004 | Weathers et al. | 141/391 |

FOREIGN PATENT DOCUMENTS

| | | | |
|---|---|---|---|
| CH | 677598 | * | 6/1991 |
| DE | 3406853 | * | 9/1985 |
| FR | 2709440 | * | 3/1995 |
| GB | 2168599 | * | 6/1986 |
| JP | 3-99622 | * | 4/1991 |
| JP | 7-16194 | * | 1/1995 |
| JP | 7-313423 | * | 12/1995 |
| JP | 10-262890 | * | 10/1998 |
| JP | 10-276959 | * | 10/1998 |
| JP | 2002-330910 | * | 11/2002 |
| JP | 2002-360491 | * | 12/2002 |

* cited by examiner

*Primary Examiner*—Mark Spisich
(74) *Attorney, Agent, or Firm*—Law Offices of John Chupa and Associates, P.C.

(57) ABSTRACT

A receptacle apparatus 10 which includes a receptacle 14 into which refuse is placed very shortly after it is placed within the apparatus 10, thereby reducing the likelihood that it will be undesirably communicated into the surrounding environment 80.

2 Claims, 5 Drawing Sheets

DISPOSAL APPARATUS

FIELD OF THE INVENTION

The present invention generally relates to a disposal apparatus and more particularly, to a disposal apparatus which allows refuse to be selectively, quickly and easily removed from a location and to be selectively and efficiently stored for later disposal while concomitantly reducing the likelihood that the collected refuse will be undesirably communicated into the environment.

BACKGROUND OF THE INVENTION

A disposal apparatus is used to selectively remove refuse, waste, and/or garbage (hereinafter all of these items are collectively referred to as "refuse") from a certain location. While such disposal apparatuses do allow the refuse to be selectively removed from a certain location, they suffer from several drawbacks.

By way of example and without limitation, these disposal apparatuses are typically in the form of dust pan having a portion upon which the refuse is selectively and forcibly positioned. Particularly, the refuse is forcibly made to lie on a top surface of the dust pan apparatus and is then hand delivered to a garbage can or other such semi-permanent assembly. During this time, before the refuse is placed into the such a semi-permanent assembly (the term "semi-permanent", in this context, means that the refuse is typically contained in an assembly which is designed to prevent it from being undesirably distributed into the environment), the supported refuse may "blow away" or otherwise be undesirably distributed into the surrounding environment, further polluting the environment and countering the very objectives that the user sought to achieve by the use of the refuse disposal apparatus.

There is therefore a need for a new and improved disposal apparatus which overcomes these and other drawbacks associated with currently used disposal apparatuses and assemblies.

SUMMARY OF THE INVENTION

It is a first non-limiting object of the present invention to provide a refuse disposal apparatus which overcomes some or all of the previously delineated drawbacks of prior refuse disposal apparatuses and assemblies.

It is a second non-limiting object of the present invention to provide a refuse disposal apparatus which overcomes some or all of the previously delineated drawbacks of prior disposal apparatuses and assemblies and which, by way of example and without limitation, provides a receptacle into which the collected refuse may be quickly and easily placed upon collection.

It is a third non-limiting object of the present invention to provide a refuse disposal apparatus which overcomes some or all of the previously delineated drawbacks of prior disposal apparatuses and assemblies and which, by way of example and without limitation, provides a wiper blade portion which may be used to selectively clean a surface.

According to a first non-limiting aspect of the present invention, a disposal apparatus is provided and includes a placement portion including a hollow protruding portion which allows communication with the placement portion; and a bag which is selectively and removably attached to the hollow protruding portion.

According to a second non-limiting aspect of the present invention, a disposal apparatus is provided and includes a placement portion which includes a wiper portion and a depressed portion which includes an outwardly protruding portion which allows communication with the depressed portion; and a bag which is selectively and removably attached to said protruding portion.

According to a third non-limiting aspect of the present invention, a disposal apparatus is provided and include a refuse reception portion having a placement portion including an expansive mouth portion with a downwardly protruding wiper portion which is linearly coextensive to the mouth portion, the placement portion further having a narrow depressed portion including a downwardly protruding and generally hollow communication portion; and a container which is selectively and removably coupled to the generally hollow communication portion.

These and other features, aspects, and advantages of the present invention will become apparent to those of ordinary skill in the art upon a reading of the following detailed description of the preferred embodiment of the invention and by reference to the following drawings.

DETAILED DESCRIPTION OF THE PREFERRED EMBODIMENTS OF THE INVENTION

Figure 1:
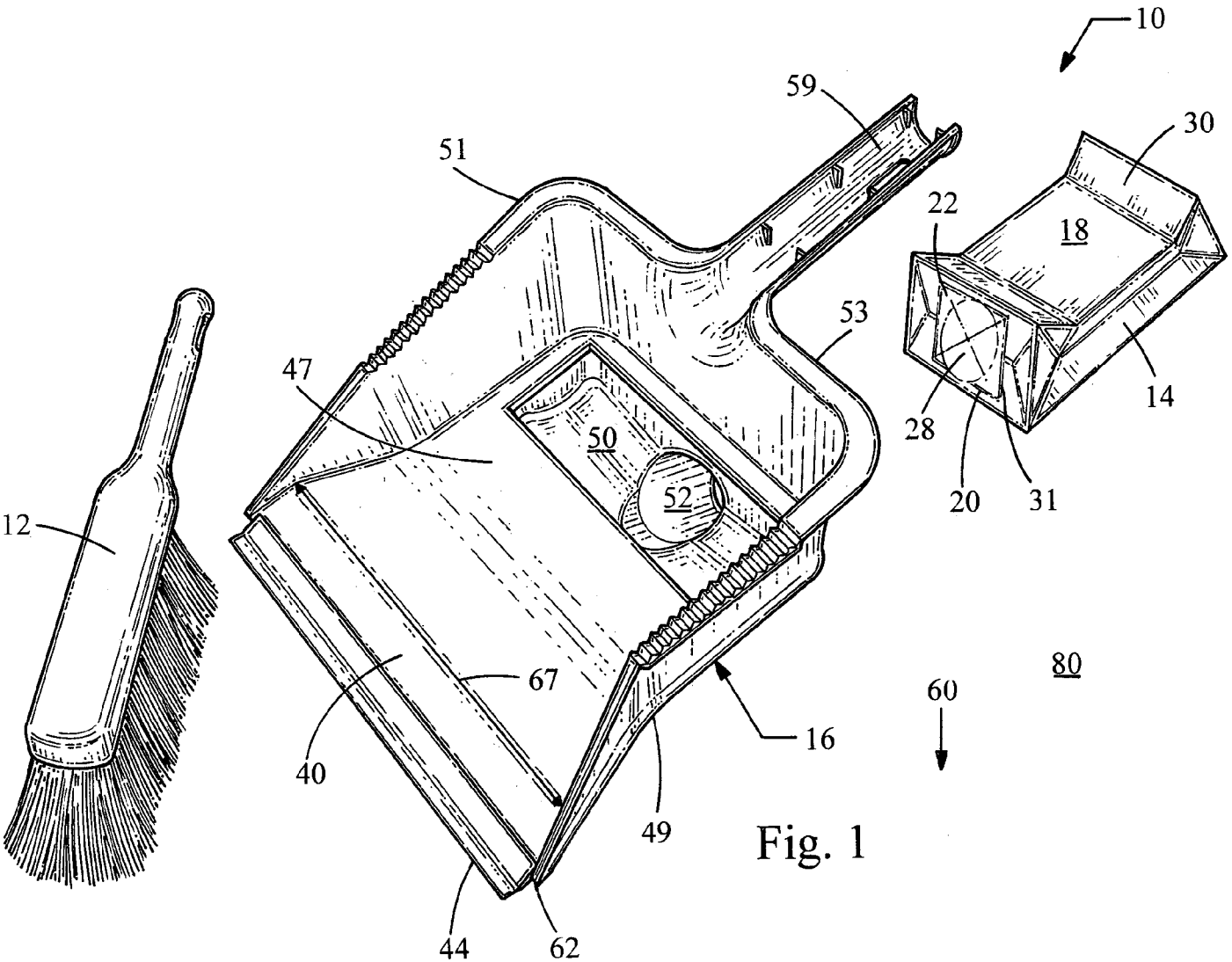
FIG. 1 is a disassembled perspective view of the disposal apparatus which is made in accordance with the teachings of the preferred embodiment of the invention.
Figure 3:
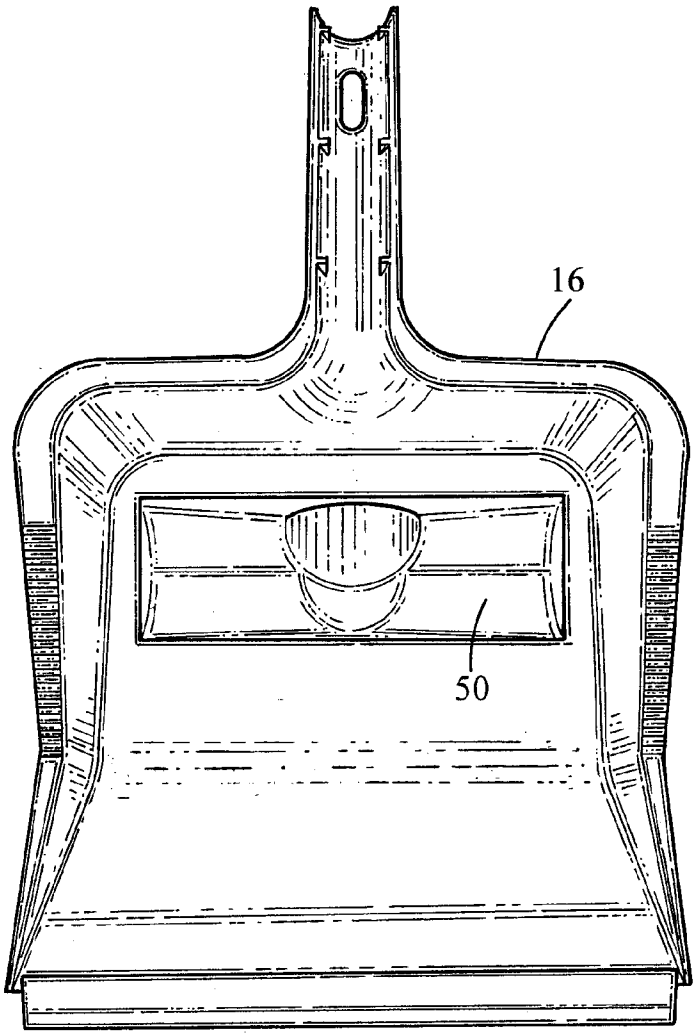
FIG. 3 is a top disassembled view of a portion of the apparatus which is shown in FIG. 1.
Figure 2:
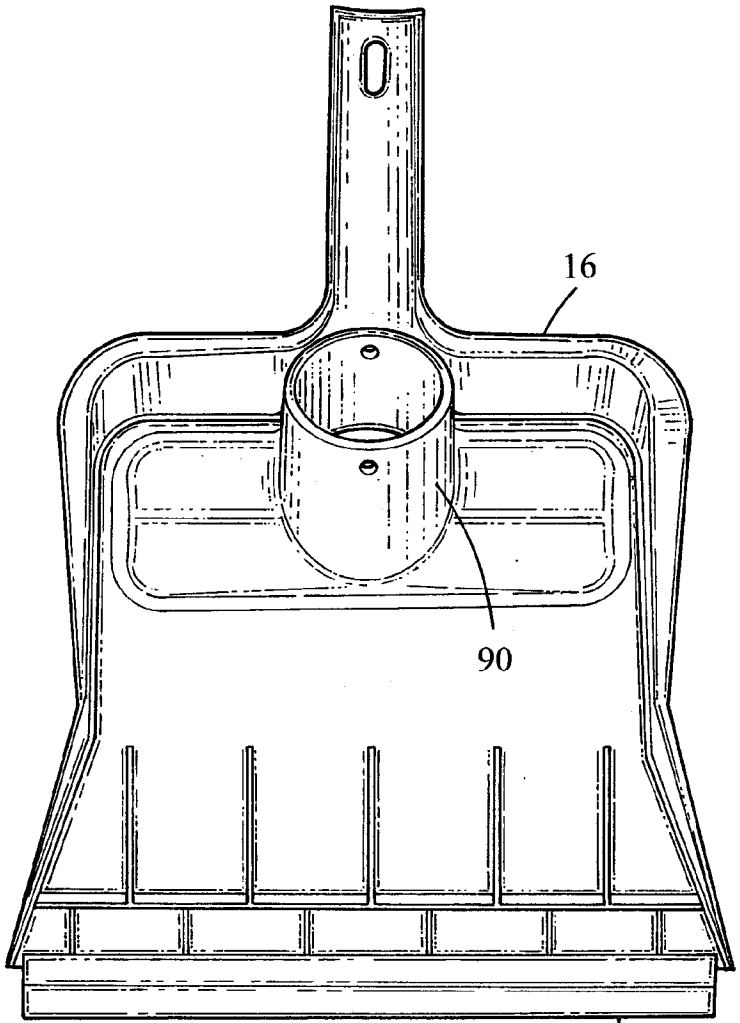
FIG. 2 is a bottom disassembled view of a portion of the apparatus which is shown in FIG. 1.
Figure 4:
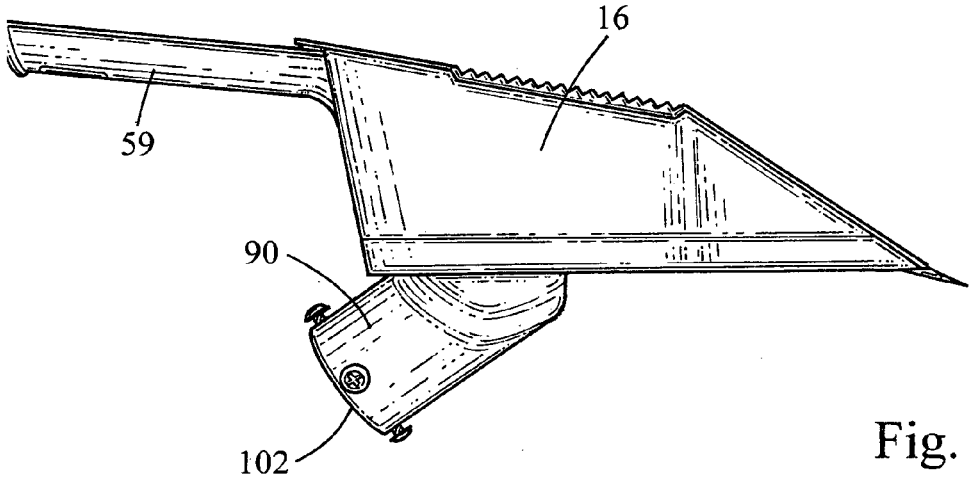
FIG. 4 is right side disassembled view of the portion of the apparatus which is shown in FIG. 3.
Figure 5:
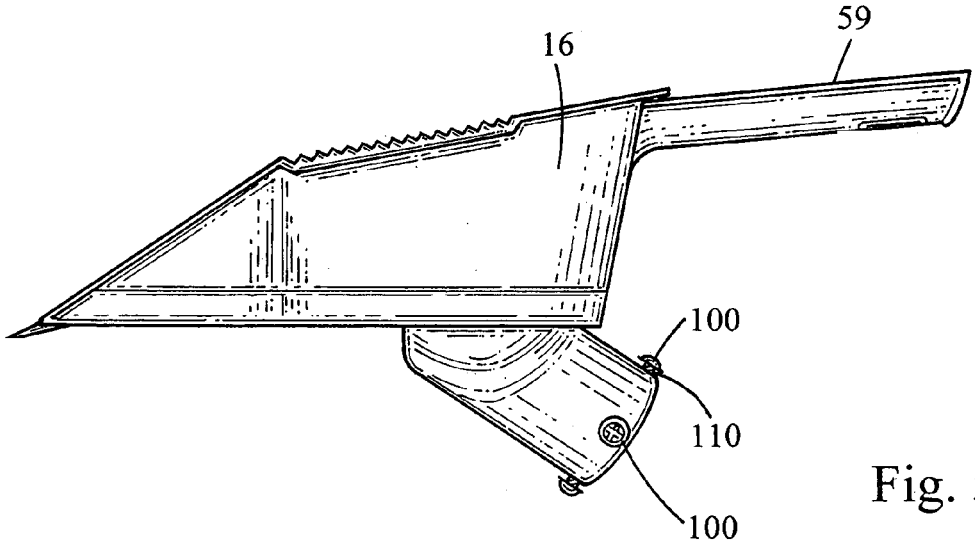
FIG. 5 is a left side disassembled view of the portion of the apparatus which is shown in FIG. 3.
Figure 6:
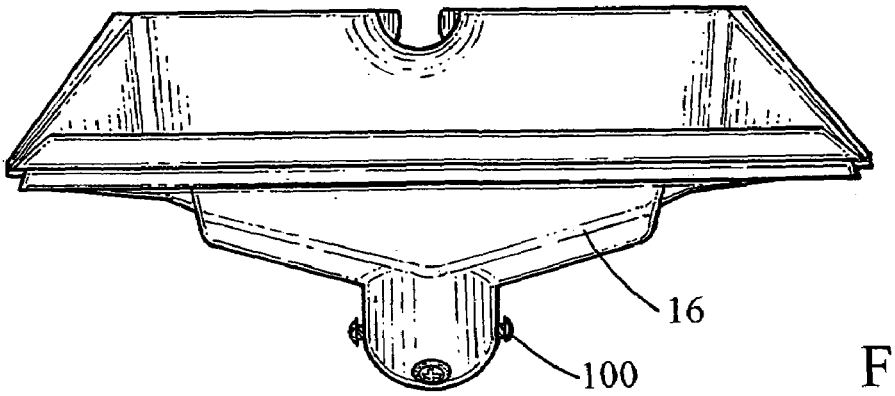
FIG. 6 is a perspective view of the portion of the apparatus which is shown in FIG. 3.
Figure 7:
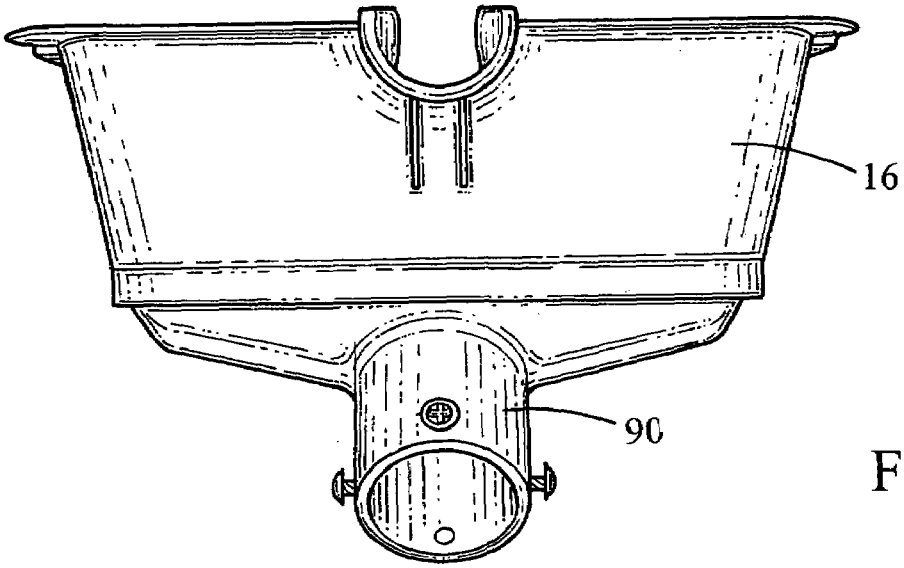
FIG. 7 is a partially rotated perspective view of the portion of the apparatus which is shown in FIG. 3.
Figure 8:
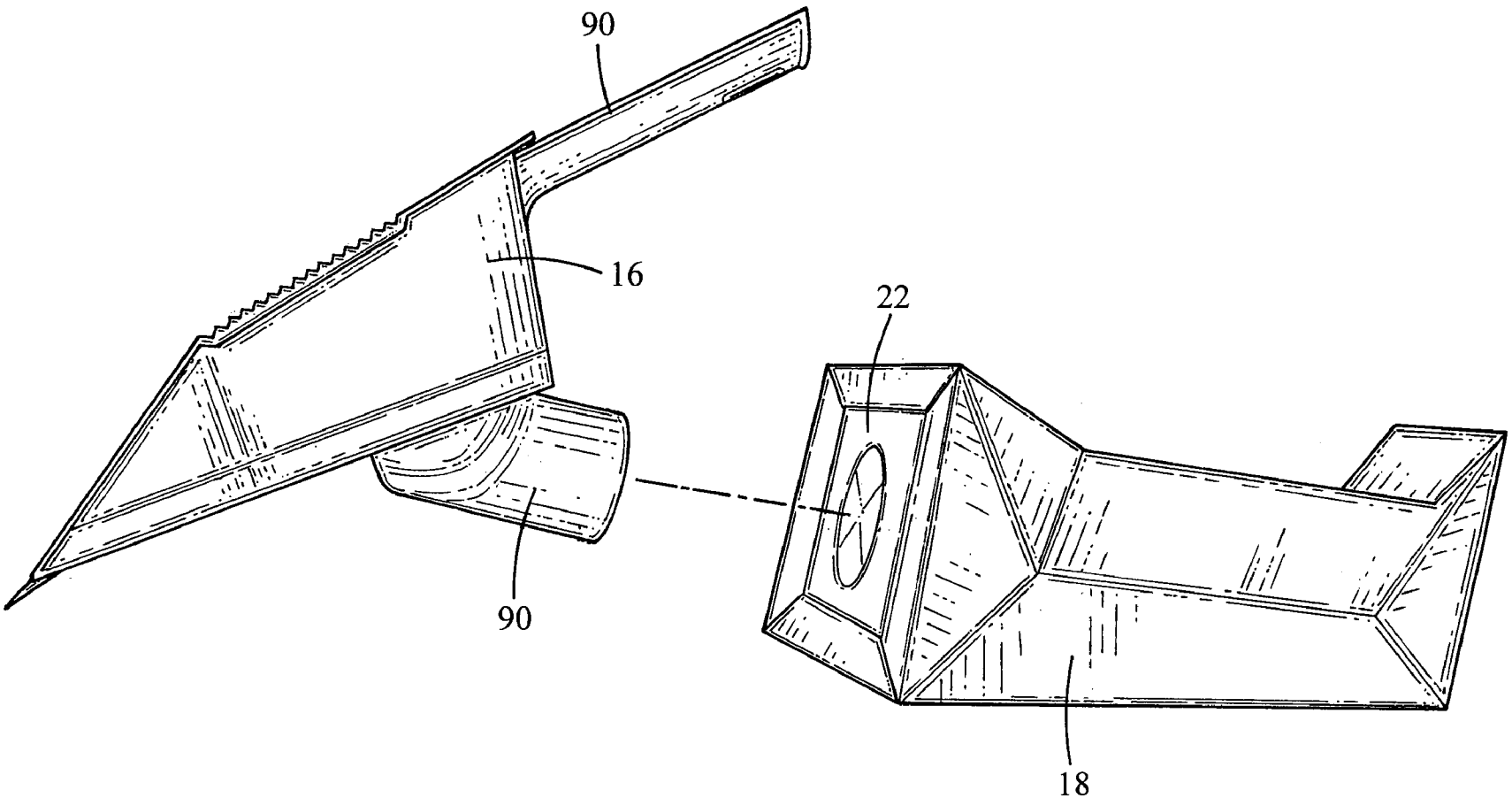
FIG. 8 is a perspective disassembled view of a second portion of the assembly which is shown in FIG. 1.

Referring now to FIGS. 1–8, there is shown a refuse disposal assembly or apparatus 10 which is made in accordance with the teachings of the preferred embodiment of the invention (it should be appreciated that the terms "apparatus" and "assembly" may be used interchangeably within this description).

Particularly, as shown in one non-limiting embodiment of the invention, the assembly 10 includes a brush 12, a generally hollow bag or refuse receptacle 14, and a initial reception or pan member 16. It should be appreciated that the brush 12 may be of any size, shape, and type and that nothing in this description is meant to limit the brush to a particular type or configuration. It should be further appreciated that the function of the brush 12 is adapted to selectively and forcibly cause refuse to be placed within and/or upon the pan member in a manner which is more fully delineated below.

It should be appreciated that the receptacle 14 may be of any desired shape and size and may be of any desired material. Further, it should be appreciated that nothing in this description should be construed to limit the bag or receptacle to a particular size and shape. Further, the receptacle 14 includes a cavity 18 and the cavity 18 is closed. That is, in the most preferred embodiment of the invention, the receptacle 14 is closed and therefore the cavity 18 is not normally accessible or open to the outside environment 20. The receptacle 18 further includes a relatively thin strike portion 22 which is composed of a material 28 which is substantially thinner than and/or different from the material 30 from which the remainder of the receptacle 14 is composed. By way of example and without limitation, the material 28 is comprised of paper and the material 30 comprises some commercially available fabric. It should be appreciated that the strike portion 22 may be any desired shape and size and, in one non-limiting embodiments is glued or otherwise affixed to the material 30. That is, the material 30 is used to substantially form the receptacle 14. However, the substantially formed receptacle has an opening 31 which is then covered by the relatively thin and easily penetrable material 28, thereby forming a strike or target portion.

As shown, the pan member 16 includes a substantially wide mouth portion 40 having a relatively thin wiper member 44 which is substantially and linearly coextensive to the mouth portion 40. As is further shown, the open mouth portion 40 allows entry into the containment portion 47 of the pan member 16 which is cooperatively formed by a pair of substantially identical sidewalls 49, 51 and a back wall 53. In one non-limiting embodiment of the invention, the pan member 16 includes an outwardly protruding handle 59 which protrudes from the back wall 53. Further, in one non-limiting embodiment of the invention, the walls 49, 51, and 53 and the handle 59 are all integrally formed with the pan member 16 (e.g., the pan member 16 is formed as a single unitary member by a process such as molding). However, in other non-limiting embodiments of the invention, the pan member 16 may be made by other different processes, such as, by way of example and without limitation, by a process in which the handle portion 59 is separately formed and later attached to the remainder of the separately formed pan member 16. Further, it should be appreciated that wiper portion 44 may be made of commercially available rubber and glued or otherwise attached to the outermost edge 62 of the pan member 16. That is, in one non-limiting embodiment, the wiper member 44 is not formed with the pan 16.

Further, as shown, the containment area or portion 47 of the pan member 16 includes a depressed or "sunk" back portion 50 having an opening 52 which allows access to the containment portion 47 by the outside environment 80. In one non-limiting embodiment of the invention, the depressed back portion 50 is generally rectangular in shape and is linearly coextensive to the back wall 53. The opening 52 is generally circular, although other shapes may be utilized. Further, and by way of example and without limitation, in one non-limiting embodiment of the invention the portion 50 is about one to about two inches lower (in the direction of arrow 60) than the outermost edge 62 upon which the wiper 44 resides. In one non-limiting embodiment of the invention, containment portion 47 has a certain dual slope characteristic. That is, as the portion 47 extends or is traversed from the center of the outermost edge 62 to about one to about two inches toward the center of the opening 52 (e.g., upon axis 67), the portion 47 has an upward slope (e.g., in a direction opposite to the direction of arrow 60) of about three to about five degrees, although other slopes may be utilized. Moreover, in this non-limiting embodiment of the invention, the slope from the center of the axis 67 to the center of the opening 52 is about ten degrees, although other slopes may be utilized.

Further, in a non-limiting embodiment of the invention, the pan member 16 includes a generally hollow member 90 which communicates with the opening 52 and which selectively receives refuse from the opening 52 and transports the material to the opening 52. In one non-limiting embodiment of the invention, the member 90 may be integrally formed with the pan member 16, or separately formed and later attached to the portion of the pan member 16 which has been previously been formed. Further, in a non-limiting embodiment, the member 90 includes a plurality of clasps or selectively movable screws 100 which are movably secured within the member 90.

In operation, the distal end 102 of the protruding portion 90 is made to strike and pierce the strike portion 22 and allows communication to occur between the cavity 18 and the opening 52, through the generally hollow interior of the member 90. In one non-limiting embodiment of the invention, the screws 100 are removed from their respective seats 110 and are each made to pierce the receptacle 14 and then placed back into their respective seat 110, thereby ensuring that the receptacle 14 is secured to the pan member 16.

The first upward slope (e.g., between the outermost edge 62 and the axis 67) allows the pan member 16 to selectively "slide under" refuse and allow the refuse to be forcibly moved into the containment area 47 by the brush 12. The second downward slope (e.g., between the axis 67 and the opening 52) causes the refuse to quickly and easily slide down into the opening 52 and into the bag or receptacle 14, through the interior of the member 90. In this manner, the refuse is substantially prevented from being communicated into the environment 20 since it is quickly and efficiently stored within the receptacle 14. When the receptacle is fully, the screws or clasps 100 are respectfully removed from their seats 110, the receptacle 14 is removed from the member 90, and the contents of the receptacle 14 are discarded. The receptacle 14 may then be "reused", or discarded and a new receptacle utilized. It should be understood that other types of clasps or screws 100 may be utilized in other non-limiting embodiments of the invention and that in another non-limiting embodiment of the invention, the receptacle 14 may have openings created in the material 30 for each of these clasps or screws 100.

It is to be understood that the invention is not limited to the exact construction and method which has been illustrated and discussed above, but that various changes and modifications may be made without departing from the spirit and the scope of the inventions as are delineated in the following claims.

The invention claimed is:

1. A disposal apparatus comprising a wide mouth; a thin wiper member which is attached to and which is linearly coextensive to said wide mouth; a pair of substantially identical sidewalls and a back wall which is coupled to said pair of substantially identical sidewalls and which cooperates with said pair of substantially identical sidewalls to form a containment portion, wherein said containment portion communicates with said wide mouth and wherein said containment portion includes a generally rectangular depressed portion having an opening and wherein said generally rectangular depressed portion has two identical parallel sidewalls which are linearly coextensive to said back wall and to said thin wiper member and wherein said containment portion includes an undulating surface formulated by a plurality of surface portions having respectively unique slopes, wherein said containment portion further includes a hollow protruding portion which communicates with said opening of said rectangular depressed portion and which protrudes from said disposal apparatus away from said mouth; a handle which terminates into said back wall and which protrudes away from said disposal apparatus in a direction from said mouth; a receptacle having a hollow body formed from a first material and which includes an opening which is completely covered by a thin piece of material; and which selectively receives said hollow protruding portion when said hollow protruding portion selectively pierces said thin piece of material; and a plurality of screws which movably terminate within said protruding portion and which are each respectively movable from a first portion in which they may be respectively removed from said protruding portion to a second position in which they may be made to each respectively pierce said receptacle, thereby cooperatively attaching said receptacle to said hollow protruding portion.

2. The disposal apparatus of claim 1 further comprising a brush.

* * * * *